US012735869B2

(12) United States Patent
Kim et al.

(10) Patent No.: US 12,735,869 B2
(45) Date of Patent: Sep. 15, 2026

(54) CONSTRUCTION MACHINE

(71) Applicant: HD CONSTRUCTION EQUIPMENT CO., LTD., Seongnam-si (KR)

(72) Inventors: Taeyoon Kim, Seoul (KR); Wooyong Jung, Seoul (KR); Kiyong Kim, Seoul (KR); Heehwan Park, Anyang-si (KR)

(73) Assignee: HD CONSTRUCTION EQUIPMENT CO., LTD., Seongnam-si (KR)

( * ) Notice: Subject to any disclaimer, the term of this patent is extended or adjusted under 35 U.S.C. 154(b) by 0 days.

(21) Appl. No.: 18/996,511

(22) PCT Filed: Jul. 14, 2023

(86) PCT No.: PCT/KR2023/010093
§ 371 (c)(1),
(2) Date: Jan. 17, 2025

(87) PCT Pub. No.: WO2024/019434
PCT Pub. Date: Jan. 25, 2024

(65) Prior Publication Data

US 2026/0015828 A1 Jan. 15, 2026

(30) Foreign Application Priority Data

Jul. 20, 2022 (KR) ..... 10-2022-0089502

(51) Int. Cl.
*E02F 9/22* (2006.01)
*E02F 3/358* (2006.01)
*E02F 9/12* (2006.01)

(52) U.S. Cl.
CPC ..... *E02F 9/2235* (2013.01); *E02F 3/358* (2013.01); *E02F 9/2267* (2013.01); *E02F 9/123* (2013.01)

(58) Field of Classification Search
CPC ..... E02F 9/2235; E02F 9/123; E02F 9/2267; F15B 11/04
See application file for complete search history.

(56) References Cited

U.S. PATENT DOCUMENTS

2019/0218751 A1 7/2019 Kim et al.

FOREIGN PATENT DOCUMENTS

JP H7-189914 A 7/1995
JP 2583148 B2 2/1997
(Continued)

OTHER PUBLICATIONS

International Search Report issued Oct. 31, 2023, corresponding to International Application No. PCT/KR2023/010093, with its English translation (5 pages).
(Continued)

*Primary Examiner* — Abiy Teka
(74) *Attorney, Agent, or Firm* — Hauptman Ham, LLP

(57) ABSTRACT

An embodiment of the present invention relates to a construction machine. The construction machine, including a swing motor, a boom cylinder, and an arm cylinder, comprises: a main pump part including a first pump, which supplies hydraulic oil to the swing motor, and a second pump, which supplies the hydraulic oil to the boom cylinder and/or the arm cylinder; a manipulation part through which a boom priority operation or a rotation priority operation is selected so that either the first pump or the second pump is operated at the maximum value of a stored horsepower ratio; and a control part for controlling the performance of the other pump not selected by the manipulation part from among the first pump and the second pump.

7 Claims, 15 Drawing Sheets

(56) References Cited

FOREIGN PATENT DOCUMENTS

| | | | | | |
|---|---|---|---|---|---|
| JP | H09324445 | A | * | 12/1997 | ..... E02F 9/2246 |
| JP | 3491940 | B2 | * | 2/2004 | |
| JP | 2016-172999 | A | | 9/2016 | |
| KR | 10-2015-0086251 | A | | 7/2015 | |
| KR | 10-2017-0008972 | A | | 1/2017 | |

OTHER PUBLICATIONS

Written Opinion issued Oct. 31, 2023, corresponding to International Application No. PCT/KR2023/010093 (4 pages).
The extended European search report dated Jun. 16, 2026 for corresponding European Patent Application No. 23843283.5 (Total 10 pages).

* cited by examiner (a)

| | Division | BM1 | BM2 | SW |
|---|---|---|---|---|
| 711 | StartP | 200 | 200 | 200 |
| 721 | upPrate | 500 | 500 | 500 |

P2 P1

(a)

| | Division | BM1 | BM2 | SW |
|---|---|---|---|---|
| 711 | StartP | 200 | 200 | 200 |
| 721 | upPrate | 500 | 100 | 100 |

P2 P1

(a)

P2 P1

| | Division | BM1 | BM2 | SW |
|---|---|---|---|---|
| 711 | StartP | 200 | 200 | 200 |
| 721 | upPrate | 500 | 70 | 70 |

(a)

P2 P1

| Division | BM1 | BM2 | SW |
|---|---|---|---|
| 711 StartP | 200 | 200 | 200 |
| 721 upPrate | 500 | 50 | 50 |

FIG. 10

P2 711 721

| Division | | StartP | upPrate | Division | | StartP | upPrate | Division | | StartP | upPrate |
|---|---|---|---|---|---|---|---|---|---|---|---|
| Default | BM1 | 200 | 500 | Case 1 | BM1 | 200 | 500 | Case 2 | BM1 | 200 | 500 |
| | BM2 | 200 | 500 | | BM2 | 100 | 500 | | BM2 | 50 | 500 |
| | SW | 200 | 500 | | SW | 100 | 500 | | SW | 50 | 500 |

P1

Default : swstartP200_swcmd295
Caes1 : swstartP150_swcmd200
Caes2 : swstartP150_swcmd175
Caes3 : swstartP150_swcmd150

CONSTRUCTION MACHINE

CROSS REFERENCE TO RELATED APPLICATION

The present application is a National Stage filing under 35 U.S.C § 371 of PCT application number PCT/KR2023/010093, filed on Jul. 14, 2023, which is based upon and claims the benefit of priority to Korean Patent Application No. 10-2022-0089502, filed on Jul. 20, 2022, in the Korean Intellectual Property Office. All of the aforementioned applications are incorporated herein by reference in their entireties.

TECHNICAL FIELD

The present disclosure relates to a construction machine, and more specifically, to a construction machine that can increase the degree of freedom in changing the swing speed of a swing body or the height of a boom by distributing the horsepower of a pump according to boom priority or swing priority, compared to a conventional machine.

BACKGROUND ART

In general, a construction machine is configured so that a swing body is rotatably supported on the upper portion of a driving body, and performs work by manipulating a boom, an arm, and an attachment placed on the swing body.

A pump receives power from an engine to generate hydraulic oil, and the construction machine is operated by controlling the flow, volume, and pressure of the hydraulic oil.

In the case of a construction machine having a bleed-off hydraulic circuit, it includes a swing pump that supplies hydraulic oil to a swing motor, and a boom pump that may supply hydraulic oil to a working machine excluding the swing motor. The construction machine performs work through a fixed horsepower ratio of the swing pump to the boom pump.

Specifically, even if the horsepower ratio is greatly increased by any one pump, there is a problem in that the pump is not actually driven by the horsepower assigned to the pump, due to the mechanical characteristics of the horsepower distribution.

Further, when the swing priority operation of the construction machine is selected by a worker, the supply of working fluid to a boom cylinder is limited if swing operation and boom lifting are simultaneously performed. Therefore, there is a problem that the boom lifting height is suppressed when a combined operation occurs in which the swing body swings from 0 degrees to 90 degrees while the boom moves simultaneously.

DETAILED DESCRIPTION OF INVENTION

Technical Problems

According to one embodiment of the present disclosure, the present disclosure provides a construction machine that can increase the degree of freedom in extending a boom cylinder, which is mechanically difficult to expand, through the horsepower distribution of a pump.

Technical Solution

Among embodiments, there is provided a construction machine including a swing motor, a boom cylinder, and an arm cylinder, the construction machine including a main pump part including a first pump, which supplies hydraulic oil to the swing motor, and a second pump, which supplies the hydraulic oil to the boom cylinder and/or the arm cylinder, a manipulation part through which a boom priority operation or a swing priority operation is selected so that either the first pump or the second pump is operated at the maximum value of a stored horsepower ratio, and a control part for controlling the performance of the other pump not selected by the manipulation part from among the first pump and the second pump.

Further, the performance of the pump controlled by the control part may include a response of the pump and a control speed of the pump.

Further, a mode capable of changing the response of the pump and the control speed of the pump may be stored in the control part.

Further, the response of the pump may include a change in initial horsepower of the pump.

Further, the control speed of the pump may include a change in horsepower increase gradient of the pump.

Further, the control part may change a pressure command value for maximum pressure control of the first pump when the second pump is selected by the manipulation part, thereby changing the control speed of the pump.

Further, the construction machine may further include an information input/output part displaying a selection status of the mode and receiving information for changing the setting of the mode.

Further, the information input/output part may change the setting of a horsepower ratio pre-stored in the manipulation part.

Among embodiments, there is provided a construction machine including a swing motor that rotates a swing body, a boom cylinder that changes a height of a boom supported on the swing body, and an arm cylinder that changes an angle between an arm supported on the boom and the boom, the construction machine including a main pump part including a first pump, which supplies hydraulic oil to the swing motor, and a second pump, which supplies the hydraulic oil to the boom cylinder, a manipulation part controlling the first pump and the second pump at a pre-stored horsepower ratio, thereby selecting either a boom priority operation or a swing priority operation, and a control part controlling the performance of the first pump so that the second pump is controlled at a pre-stored maximum horsepower ratio and a swing speed increase rate of the swing body is reduced when the boom priority operation is selected by the manipulation part.

Further, the control part may store multiple modes in which the response of the pump and the control speed of the pump are set differently.

Further, the control part may control the performance of the first pump by adjusting a pressure command value.

Effect of Invention

According to embodiments of the present disclosure, a construction machine can improve the efficiency of loading as a boom moves in a state where a swing body rotates 90 degrees by adjusting the initial pressure of a pump for controlling the pump and the torque increase gradient of the pump.

BRIEF DESCRIPTION OF THE DRAWING

FIG. 10 shows a state in which the initial horsepower of the first pump is varied as a variable according to an embodiment of the present disclosure.

BEST MODE FOR CARRYING OUT THE INVENTION

Figure 1:
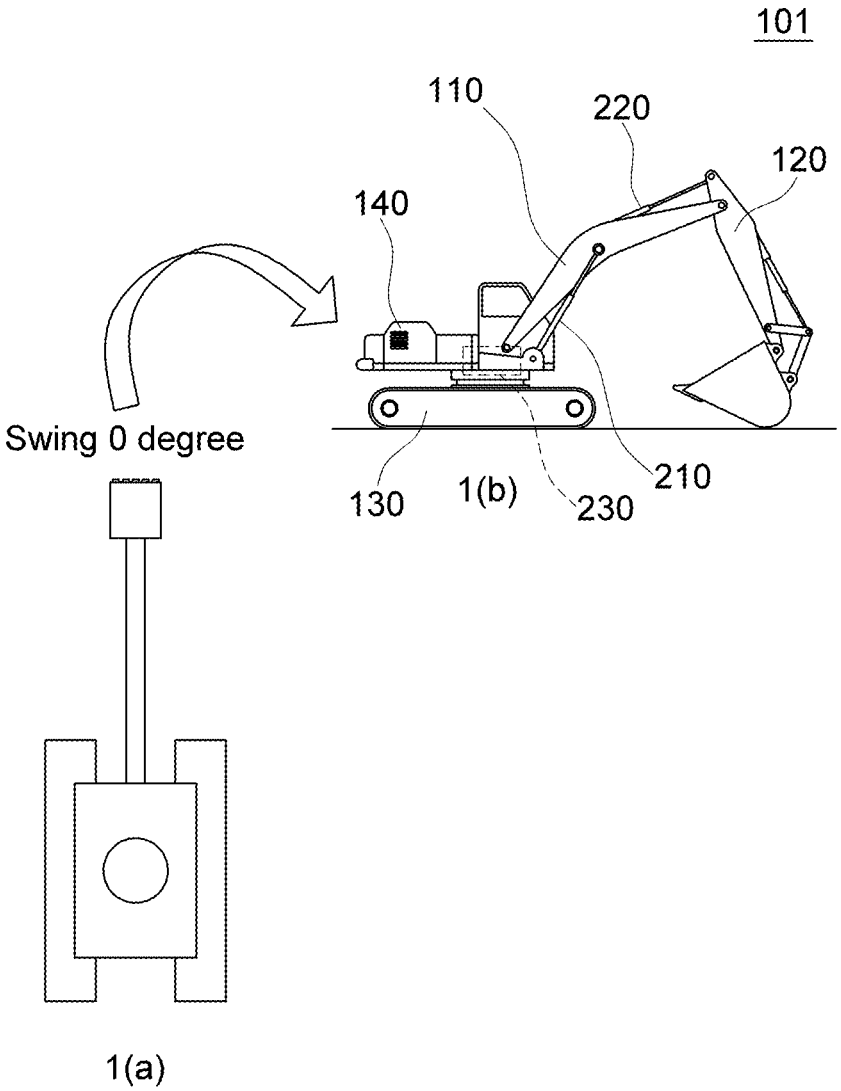
FIG. 1 shows a construction machine according to an embodiment of the present disclosure.

Hereinafter, embodiments of the present disclosure will be described in detail with reference to the accompanying drawings such that those skilled in the art can easily practice the present disclosure. However, the present disclosure may be implemented in various ways without being limited to particular embodiments described herein.

It is to be noted that the drawings are schematic and not drawn to scale. Furthermore, the size or shape of components shown in the drawings may be exaggerated for the clarity and convenience of description. Any dimensions are for illustrative purposes only and are not limiting. The same reference numerals are used throughout the drawings to designate the same or similar components.

The embodiments of the present disclosure specifically represent ideal embodiments. As a result, various modifications to the illustrations are anticipated. Accordingly, the embodiments are not limited to the specific forms depicted in the drawings but include modifications in shape resulting from manufacturing, for example.

Hereinafter, a construction machine 101 according to an embodiment of the present disclosure will be described with reference to FIGS. 1 to 15.

As shown in FIG. 1, the construction machine 101 includes a swing body 140, a driving body 130, a boom 110, an arm 120, a swing motor 230, a boom cylinder 210, and an arm cylinder 220.

The swing body 140 is rotatably supported on the driving body 130. The swing motor 230 enables the swing body 140 to swing from the driving body 130. Specifically, the swing motor 230 is operated by receiving hydraulic oil.

The boom 110 is supported on the swing body 140. The boom cylinder 210 receives hydraulic oil and extends or contracts to change the height and rotation angle of the boom 110.

The arm 120 is supported on the boom 110. The arm cylinder 220 receives hydraulic oil to extend or contract and changes an angle between the boom 110 and the arm 120. Further, an attachment is installed in an area of the arm 120 that is not supported by the boom 110.

Thus, the construction machine 101 performs work by adjusting a height between the ground and the attachment through the swing operation of the swing body 140 and the angle change of the boom 110 or arm 120.

Figure 2:
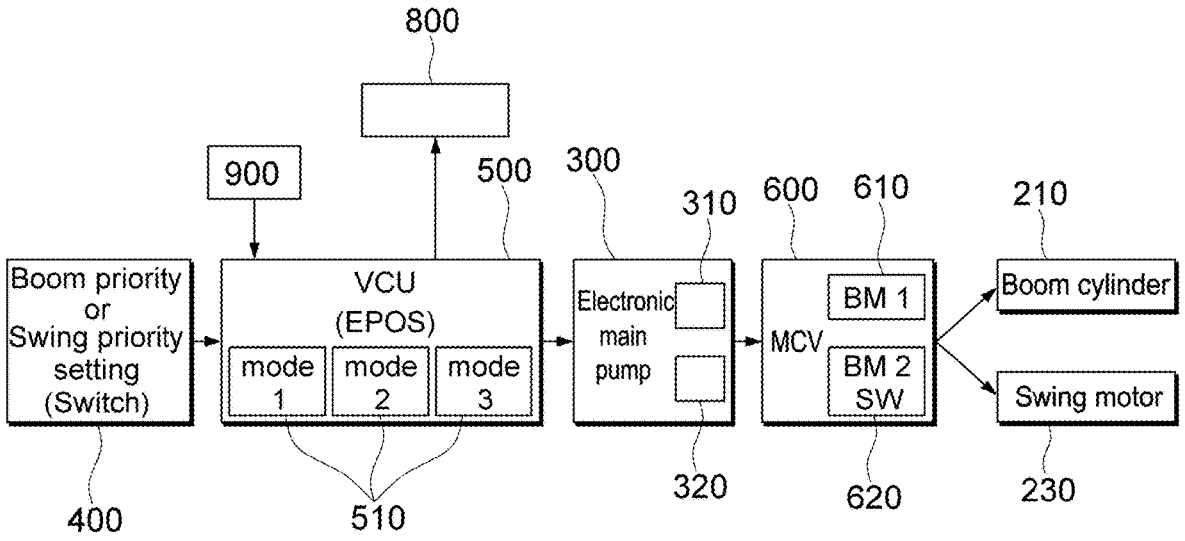
FIG. 2 is a block diagram illustrating the configuration of the construction machine according to an embodiment of the present disclosure.

As shown in FIGS. 1 and 2, the construction machine 101 according to an embodiment of the present disclosure includes a main pump part 300, a manipulation part 400, and a control part 500. Specifically, the construction machine 101 may perform bleed-off control to return a portion of the hydraulic oil discharged from the main pump part 300 to a tank.

The main pump part 300 includes a first pump 310 and a second pump 320. Specifically, the main pump part 300 is operated by an engine (not shown) to generate hydraulic oil. For example, the main pump part 300 may be an electronic pump.

To operate the swing body 140, the boom 110, and the arm 120, the main pump part 300 supplies hydraulic oil to the swing motor 230, the boom cylinder 210, and the arm 120 cylinder.

The main pump part 300 includes a first pump 310 and a second pump 320. For example, the main pump part 300 may be an electronic pump.

The first pump 310 supplies hydraulic oil to the swing motor 230. Alternatively, the first pump 310 may supply hydraulic oil to the arm cylinder 220.

The second pump 320 may supply hydraulic oil to the boom cylinder 210. Further, the second pump 320 may supply hydraulic oil to the boom cylinder 210 and the arm cylinder 220. The boom cylinder 210 may receive hydraulic oil from the first pump 310 and the second pump 320.

The manipulation part 400 is manipulated by a worker. Further, the worker selects the boom priority operation or the swing priority operation through the manipulation part 400. The manipulation part 400 is set to operate either the first pump 310 or the second pump 320 at the maximum value of the stored horsepower ratio depending on the boom priority operation or the swing priority operation.

Specifically, when the boom priority operation is selected by the manipulation part 400, the second pump 320 may be operated at the maximum value of the stored horsepower ratio.

For example, the second pump 320 may be a boom priority pump.

Alternatively, when the swing priority operation is selected by the manipulation part 400, the first pump 310 may be operated at the maximum value of the stored horsepower ratio. Further, the first pump 310 may preferentially supply hydraulic oil to the swing motor 230 or the arm cylinder 220 in response to the manipulation signal of a joystick.

For example, the first pump 310 may be a swing priority pump or an arm priority pump.

That is, as the worker selects the boom priority operation or the swing priority operation by the manipulation part 400, either the first pump 310 or the second pump 320 may be operated at the maximum value of the pre-stored horsepower ratio.

Specifically, when the boom priority operation is selected by the manipulation part 400, the second pump 320 may be operated at the maximum value of the pre-stored horsepower ratio. Alternatively, when the swing priority operation is selected by the manipulation part 400, the first pump 310 may be operated at the maximum value of the pre-stored horsepower ratio.

Figure 5:
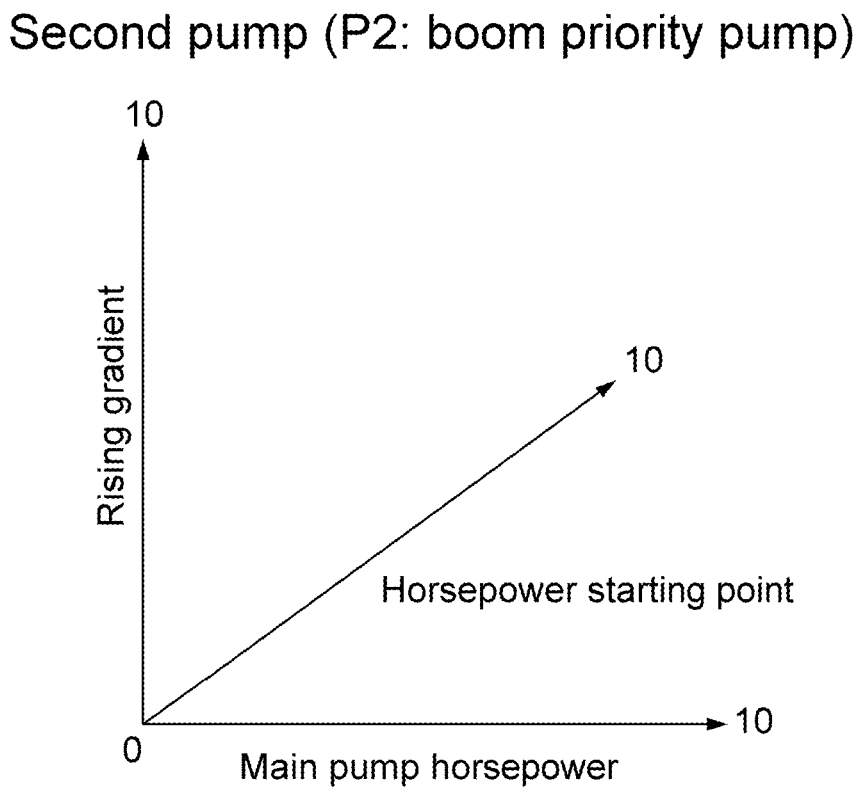
Figure 6:
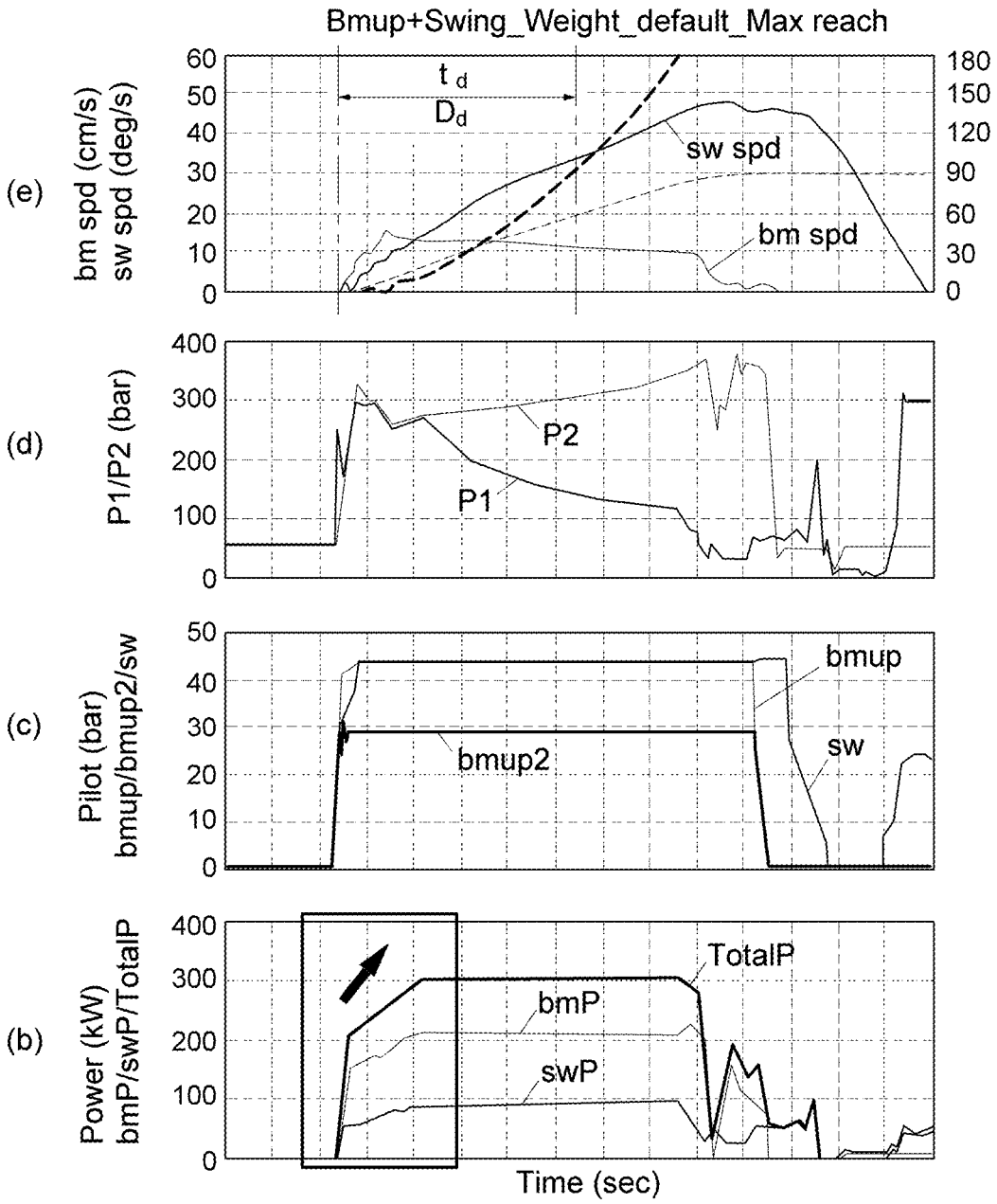
FIGS. 6 to 9 show changes in pressure, horsepower, and speed when a boom of the construction machine rises and a swing body rotates simultaneously according to a change in a horsepower increase gradient of the first pump, in an embodiment of the present disclosure.

As shown in FIGS. 6 and 5, the horsepower ratio may be the ratio of the total horsepower of the main pump part 300 operated by the engine to the horsepower distributed to the first pump 310 and the second pump 320. Thus, the horsepower ratio distributed to each of the first pump 310 and the second pump 320 in the total horsepower of the main pump part 300 by the engine is pre-stored depending on the boom priority operation or the swing priority operation.

The control part 500 may control the performance of a pump that is not selected by the manipulation part 400, among the first pump 310 or the second pump 320. Specifically, when either the boom priority operation or the swing priority operation is selected by the manipulation part 400, the control part 500 may control the performance of the other pump, and may control the pump for which the selected boom priority operation or the selected swing priority operation is selected at a pre-stored maximum horsepower ratio.

That is, the construction machine 101 may select the boom priority operation or the swing priority operation through the manipulation part 400 so that either the first pump 310 or the second pump 320 is controlled at the maximum horsepower ratio stored for the selected operation, and control the performance of a pump which is not selected.

Through such a configuration, the construction machine 101 according to an embodiment of the present disclosure allows a worker to select the boom priority operation or the swing priority operation through the manipulation part 400, thereby increasing the height adjustment range of the boom 110 and enabling the swing body 140 to swing more quickly compared to a conventional construction machine according to a worker's needs. That is, the construction machine 101 allows the worker to select the boom priority operation or the swing priority operation through the manipulation part 400, thereby allowing the boom cylinder 210 to have a longer extension length than the conventional construction machine.

Further, the performance of the pump according to an embodiment of the present disclosure may include a response 710 of the pump and a control speed 720 of the pump.

The control part 500 may control the response 710 of the pump and the control speed 720 of the pump. Specifically, the control part 500 may control an initial horsepower 711 of the pump and a horsepower increase gradient 721 of the pump (torque increase gradient of the pump).

The response 710 of the pump may be controlled by changing the initial horsepower 711 of the pump.

Specifically, the control part 500 may control the initial pressure StartP at the initial operation of the pump to control the response 710 of the pump. At this time, the initial pressure StartP of the pump may be pressure that is immediately increased for the operation of a working machine in response to an operation signal of the pump. That is, the initial pressure StartP of the pump may be an initial pump pressure that is output when an ON signal is input to operate the pump.

Specifically, as shown in FIG. 10, the initial pressure StartP of the second pump 320 may be fixed, and the initial pressure StartP of the first pump 310 may be changed.

The control speed 720 of the pump may be controlled by changing the horsepower increase gradient 721 of the pump.

The control part 500 may determine the horsepower increase gradient 721 of the pump following the initial horsepower 711 of the pump to control the control speed 720 of the pump. That is, the horsepower increase gradient 721 of the pump may be an increase gradient from the initial pressure StartP of the pump to a target control pressure of the pump. Therefore, the control part 500 may adjust the acceleration of the control speed 720 of the pump by controlling the pressure increase gradient upPrate of the pump.

That is, in order to solve the problem of the conventional construction machine in which the pump does not produce more horsepower due to the horsepower control (the limit horsepower of the pump) when the pump is controlled only by controlling the horsepower ratio of the pump, the control part 500 of the construction machine 101 of the present disclosure can effectively adjust the performance of the pump by adjusting the initial horsepower of the pump and the horsepower increase gradient of the pump.

For example, FIGS. 6 to 9 show a state in which the manipulation part 400 selects the priority of the boom 110, so that the lifting operation of the boom 110 and the rotation of the swing body 140 are performed simultaneously. The control part 500 operates the second pump 320 at the maximum horsepower and controls the performance of the first pump 310.

FIG. 6 shows a reference example, and shows that the first pump 310 and the second pump 320 are operated at the same initial pressure StartP and the pump horsepower increase gradient 721. Specifically, as shown in FIG. 6(*a*), the second pump 320 has the initial pressure StartP of 200 and the pressure increase gradient upPrate of the pump that is set to 500, and the first pump 310 has the initial pressure StartP of 200 and the pressure increase gradient upPrate of the pump that is set to 500.

When the lifting operation of the boom 110 and the swing of the swing body 140 are performed together, as shown in FIG. 6(*e*), the swing time of the swing body 140 from 0 to 90 degrees is td, as indicated in a graph of the swing angular velocity (sw spd(deg/s)) of the swing body 140 and the lifting velocity (bm spd(cm/s)) of the boom 110 over time. At this time, the lifting height of the boom 110 is indicated as Dd.

Further, FIG. 6(*d*) shows a graph indicating the pressure P1 of the first pump 310 and the pressure P2 of the second pump 320 over time.

Further, FIG. 6(*b*) shows a graph indicating the horsepower swP of the first pump 310 and the horsepower bmP of the second pump 320 over time.

Further, FIG. 6(*c*) shows pilot pressure for controlling a second boom valve and a swing valve 620 or a first boom valve 610.

Figure 7:
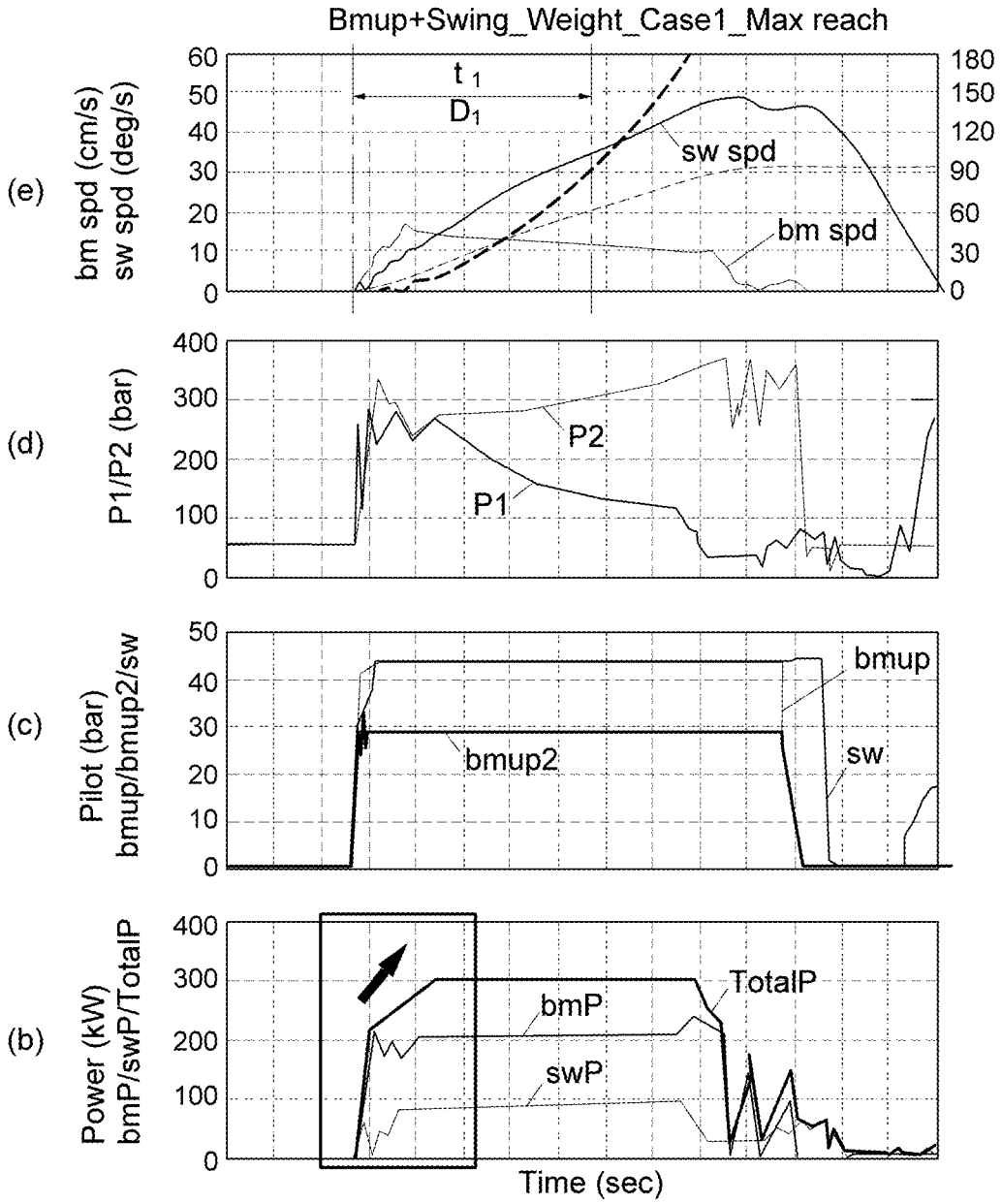

As shown in FIG. 7(*a*), the second pump 320 has the initial pressure StartP of 200 and the pressure increase gradient upPrate of the pump that is set to 500, and the first pump 310 has the initial pressure StartP of 200 and the pressure increase gradient upPrate of the pump that is set to 100.

Figure 8:
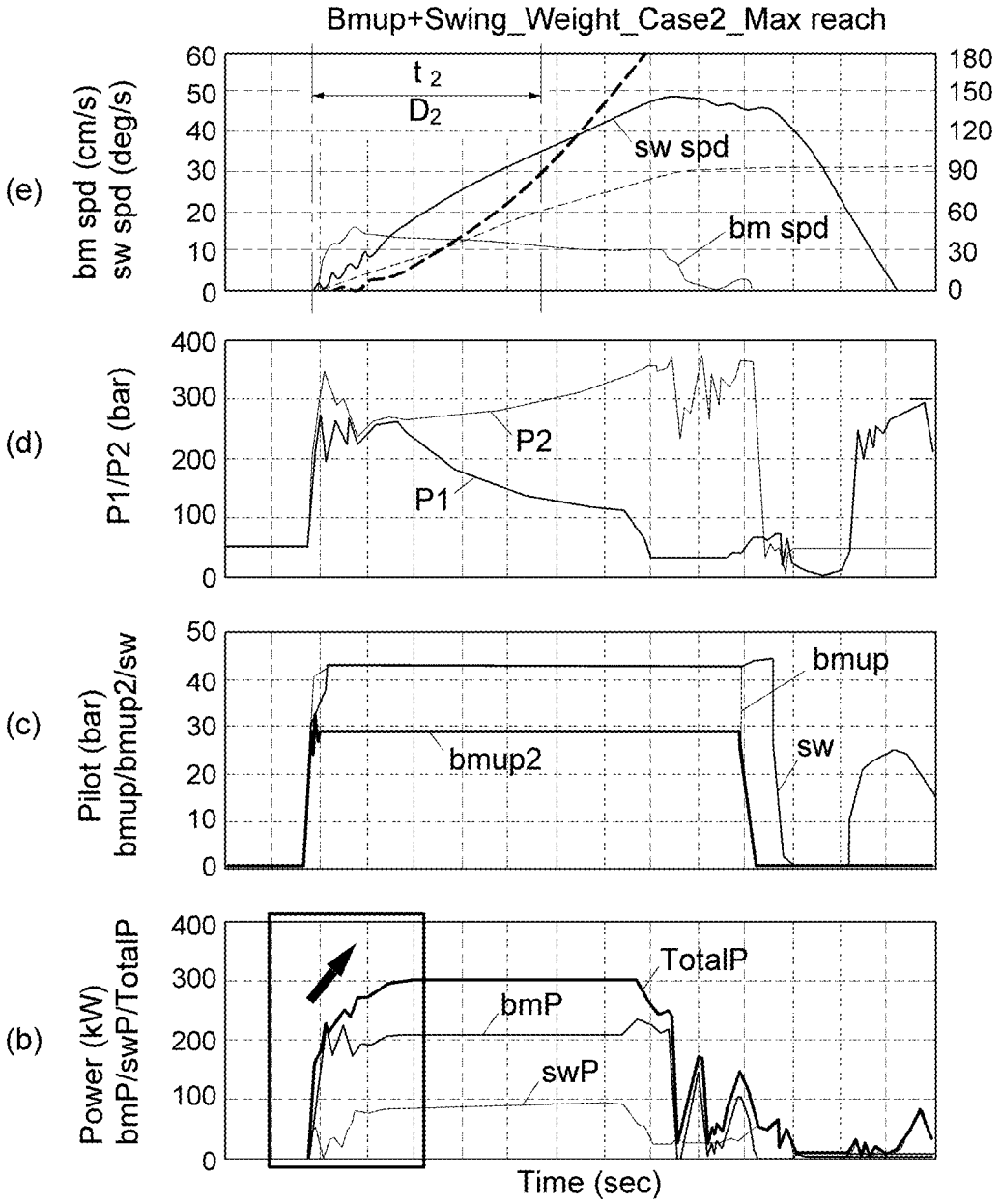

As shown in FIG. 8(*a*), the second pump 320 has the initial pressure StartP of 200 and the pressure increase gradient upPrate of the pump that is set to 500, and the first pump 310 has the initial pressure StartP of 200 and the pressure increase gradient upPrate of the pump that is set to 70.

Figure 9:
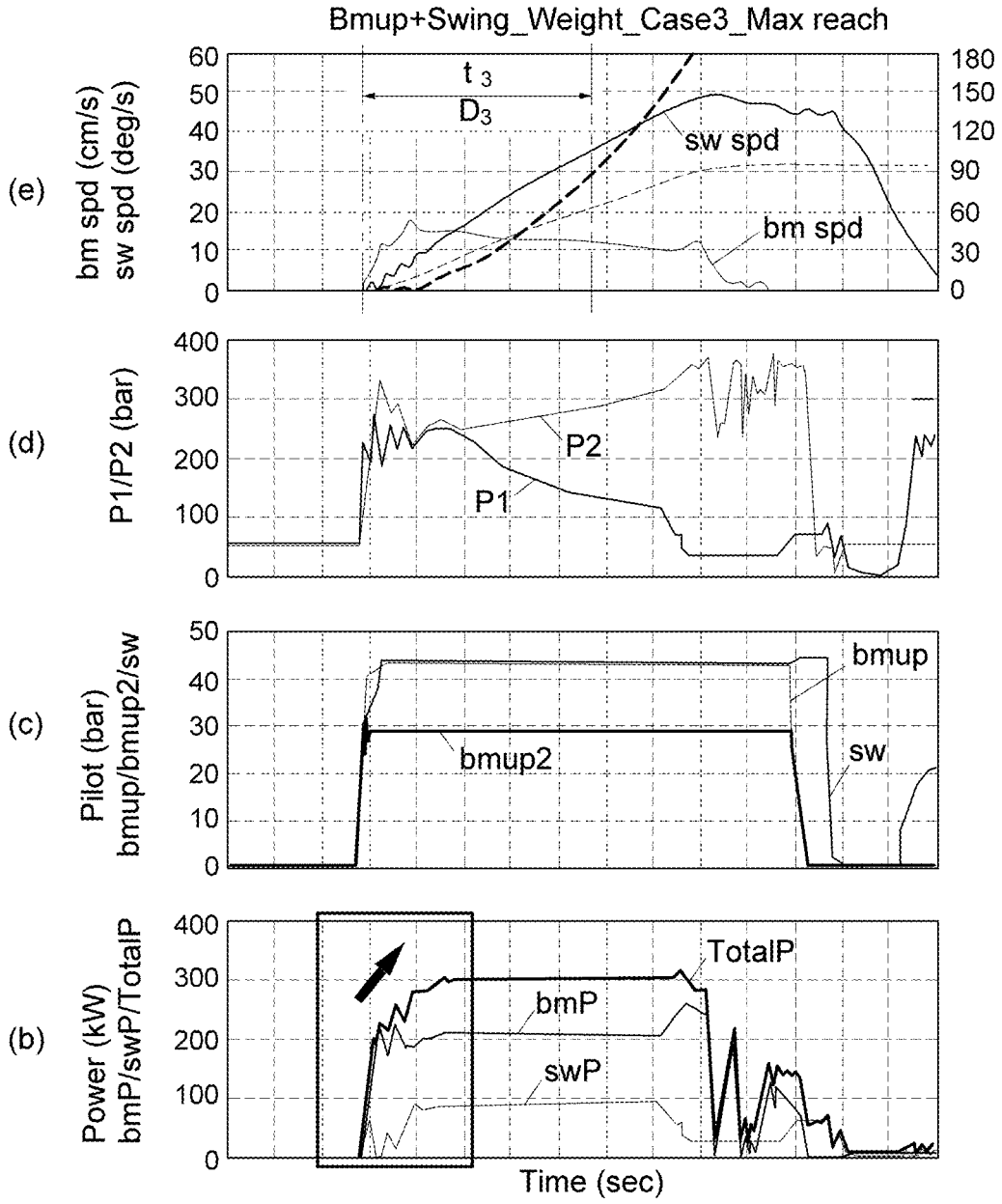

As shown in FIG. 9(*a*), the second pump 320 has the initial pressure StartP of 200 and the pressure increase gradient upPrate of the pump that is set to 500, and the first pump 310 has the initial pressure StartP of 200 and the pressure increase gradient upPrate of the pump that is set to 50.

Comparing FIGS. 6(*b*) to 9(*b*), when the manipulation part 400 selects the boom priority operation and the second pump 320 is operated at the maximum horsepower ratio, referring to the arrow in the rectangular area of each drawing, it can be seen that the pressure gradient of the first pump 310 becomes gentler over time as the pressure increase gradient upPrate of the first pump 310 has a smaller value, as shown in FIGS. 6(*d*) to 9(*d*).

At this time, when comparing FIGS. 6(*e*) to 9(*e*), it can be seen that the swing time of the swing body 140 from 0 degrees to 90 degrees tends to increase and the lifting length of the boom 110 increases.

Specifically, the swing time of the swing body 140 from 0 degrees to 90 degrees is represented as $t_d>t_1>t_3>t_2$. At this time, the extension length of the boom 110 is represented as $D_3>D_2>D_1>D_d$.

Thus, as the pressure increase gradient upPrate of the first pump 310 is set lower over the prior art, the rotation speed of the swing body 140 from 0 to 90 degrees tends to decrease. Further, the extension length of the boom cylinder 210 is shown as being longer.

Further, when comparing FIGS. 6(*d*) to 9(*d*), it can be seen that the pump pressure increase gradient of the first pump 310 decreases together as the horsepower increase gradient of the first pump 310 relatively becomes low.

Thus, as shown in FIGS. 1, 6 to 9, when the manipulation part 400 selects the priority of the boom 110 and the lifting operation of the boom 110 and the swing of the swing body 140 are performed together, It can be seen that the lower the horsepower increase gradient of the first pump 310 is set, the lower the pressure increase gradient of the first pump 310 becomes, and the slower the swing operation of the swing body 140. At this time, it can be seen that the extension length of the boom cylinder 210 also increases. That is, the horsepower ratio of the second pump 320 may be operated at maximum and the performance of the first pump 310 may be controlled, so that the degree of freedom in the extension change of the boom cylinder 210 may increase and the swing speed of the swing body 140 may be varied more gradually over the prior art.

Figure 3:
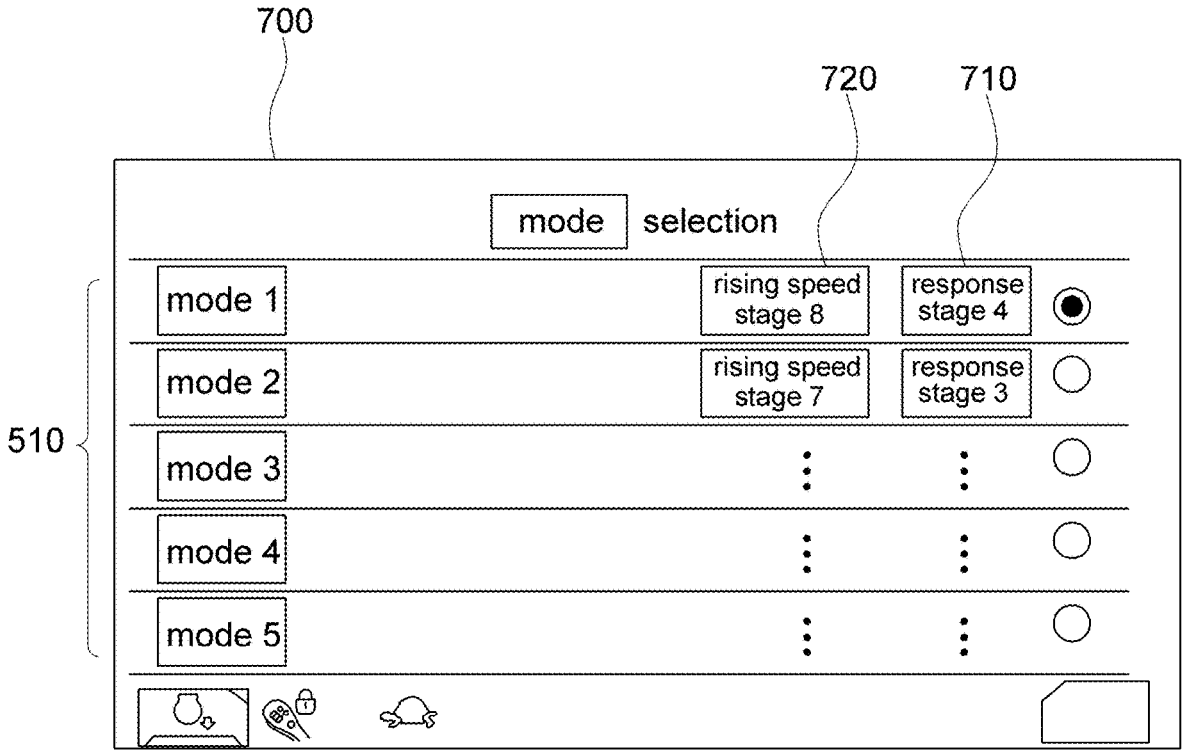
FIG. 3 shows the mode setting of a control part according to an embodiment of the present disclosure.
Figure 4:
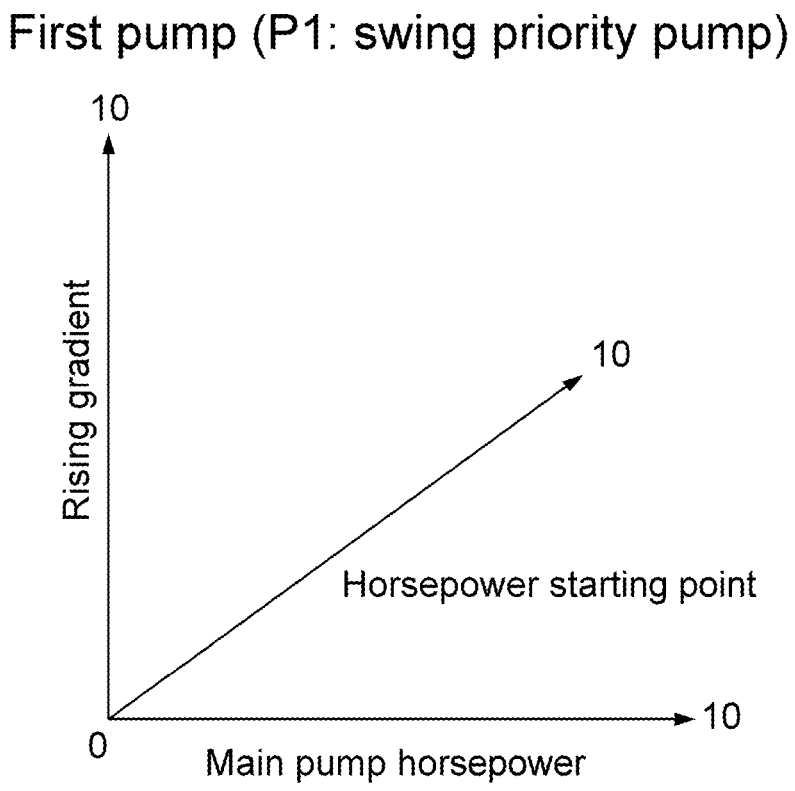
FIGS. 4 and 5 show the horsepower ratio of a first pump or a second pump to a total horsepower of a main pump part.

Further, in the control part 500 according to an embodiment of the present disclosure, a mode 510 capable of changing the response 710 of the pump and the control speed 720 of the pump may be stored, as shown in FIGS. 2 and 3.

The control part 500 may store the mode 510 in which a worker may change the response 710 of the pump and the control speed 720 of the pump.

Specifically, the control part 500 may store a plurality of modes 510 having different pump responses 710 or different pump control speeds 720.

The worker may select any one of the plurality of modes 510, or the worker may change the response 710 of the pump and the control speed 720 of the pump stored in the mode 510.

Therefore, the construction machine 101 sets the plurality of modes 510, which may control the performance of the pump, in the control part 500, so that work may be performed by adjusting the performance of the pump in various levels.

As shown in FIG. 3, the construction machine 101 according to an embodiment of the present disclosure may further include an information input/output part 700.

The information input/output part 700 may be installed in a cabin of the swing body 140 to display the selection status information of the mode 510 to the worker.

Further, the information input/output part 700 may receive from the worker information for changing the setting of the response 710 of the pump or the control speed 720 of the pump in the mode 510.

Specifically, the information input/output part 700 may display the response 710 of the pump or the control speed 720 of the pump in multiple differential steps so that the worker can easily recognize it.

Alternatively, the information input/output part 700 may display the response 710 of the pump or the control speed 720 of the pump in figures so that the worker can easily recognize it.

For example, the information input/output part 700 may be formed as a touch panel. Alternatively, the information input/output part 700 may be a dashboard.

Further, the input/output part 700 according to an embodiment of the present disclosure information may guide the worker to change the setting of the horsepower ratio stored in the manipulation part 400.

The worker may change the setting of the horsepower ratio of the first pump 310 and the second pump 320 according to the boom priority operation or the swing priority operation when manipulating the manipulation part 400 through the information input/output part 700.

The horsepower ratio of the first pump 310 and the second pump 320 according to the changed boom priority operation or swing priority operation may be reset so that the first pump 310 and the second pump 320 may be operated at the changed horsepower ratio when the worker selects the manipulation part 400.

For example, when the manipulation part 400 selects the boom priority operation, the stored horsepower ratio of the first pump 310 and the second pump 320 may be controlled at the ratio of 3:7. At this time, the second pump 320 may be controlled at a maximum horsepower ratio of 7.

Alternatively, when the manipulation part 400 selects the swing priority operation, the stored horsepower ratio of the first pump 310 and the second pump 320 may be controlled at the ratio of 5:5. At this time, the first pump 310 may be controlled at a maximum horsepower ratio of 5.

The worker may change the horsepower ratio of the first pump 310 and the second pump 320 according to the boom priority operation or swing priority operation described above through the information input/output part 700.

Subsequently, the first pump 310 and the second pump 320 may be controlled based on the horsepower ratio of the first pump 310 and the second pump 320 whose settings are changed and saved according to selection of the boom priority operation or boom swing operation of the manipulation part 400.

The construction machine 101 according to an embodiment of the present disclosure may further include a pump pressure sensor 900, as shown in FIGS. 2, 11 to 13.

The pump pressure sensor 900 may detect the pressure of the main pump part 300. Specifically, the pump pressure sensor 900 may detect the pressure of hydraulic oil discharged from the first pump 310. Further, the pressure information of the hydraulic oil discharged from the first pump 310, detected by the pump pressure sensor 900, may be transmitted to the control part 500.

The pressure of hydraulic oil discharged from the first pump 310 may be maintained so that the pressure of the working fluid supplied to the swing motor 230 does not exceed the pressure command value SWcmd. The control part 500 may change a pressure command value SWcmd.

That is, the control part 500 may change the pressure command value SWcmd so that the pressure of the working fluid to the swing motor 230 may be maintained without exceeding the pressure command value SWcmd. Further, the control part 500 may check the status information of the pressure discharged from the first pump 310 based on the pressure information of the hydraulic oil transmitted from the pump pressure sensor 900. That is, the control part 500 may adjust and change the pressure command value SWcmd for swing acceleration through the pressure information detected by the pump pressure sensor 900. In other words, the pressure command value SWcmd formed in the main pump part 300 may be adjusted to variably form the swing acceleration of the construction machine 101.

At this time, the pressure command value SWcmd of the first pump 310 may be a swing relief pressure. That is, the maximum pressure to be output by the first pump 310 may be controlled by the control part 500 controlling the pressure command value SWcmd. The control part 500 may check the current pressure control status, output from the first pump 310, based on the information of the pump pressure sensor 900 that detects the output pressure information of the first pump 310.

Therefore, the pressure command value SWcmd of the control part 500 is pressure that is to be maintained by the first pump 310 after the initial horsepower 711 of the pump on the pressure diagram of the first pump 310 over time. Specifically, the control part 500 may control the maximum value of pressure that the first pump 310 should maintain by controlling the pressure command value SWcmd. Thus, the control part 500 may control the acceleration gradient of the first pump 310 by adjusting the pressure command value SWcmd, the pressure increase gradient uprate, and the initial pressure StartP of the pump. The pump performance may be controlled by the pressure command value SWsmd adjusted by the control part 500, so that the swing acceleration of the swing body 140 may be varied.

That is, the control part 500 controls the pressure command value SWcmd to determine a maximum pressure value that is to be maintained by the first pump 310 and adjust the rotation speed of the swing body 140 according to the horsepower pressure increase gradient upPrate of the pump directed thereto.

Accordingly, time taken for the swing body 140 of the construction machine 101 to rotate from 0 to 90 degrees may be adjusted.

In other words, the control part 500 may adjust the horsepower increase gradient 721 of the first pump 310 by controlling the discharge pressure of the first pump 310.

Alternatively, the construction machine 101 according to an embodiment of the present disclosure may further include a swing relief valve 800.

The swing relief valve 800 may selectively open or close a flow path so that the pressure of the hydraulic oil discharged from the first pump 310 is maintained without exceeding the pressure command value of the working fluid when supplied to the swing motor 230. That is, the swing relief valve 800 may change the swing acceleration by variably controlling the pressure command value by the control part 500.

Figure 11:
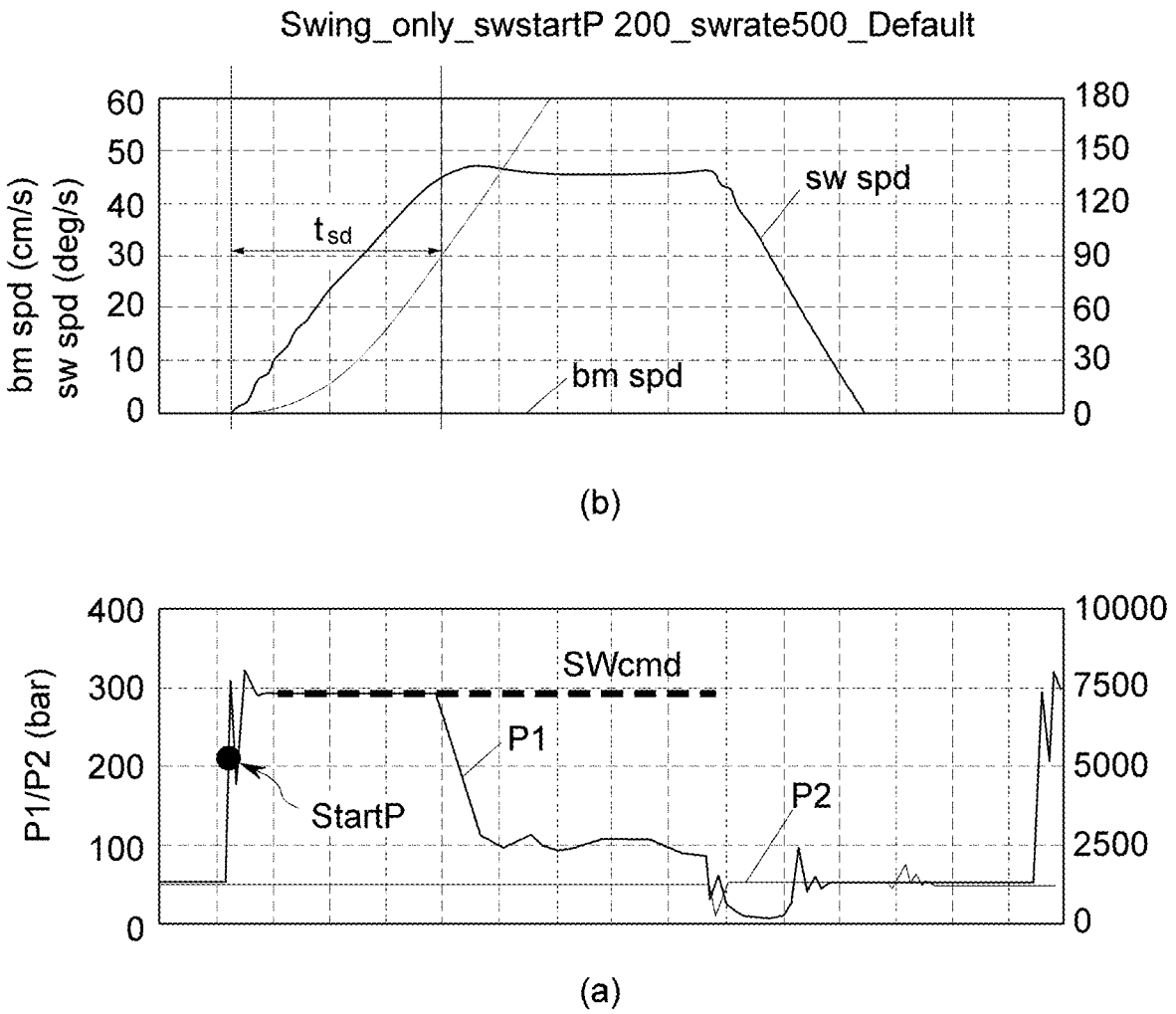
FIGS. 11 to 13 show changes in pressure and speed when only the swing motion of the swing body of the construction machine is performed according to a change in a pressure increase gradient of the first pump or a change in initial pressure, according to an embodiment of the present disclosure.
Figure 12:
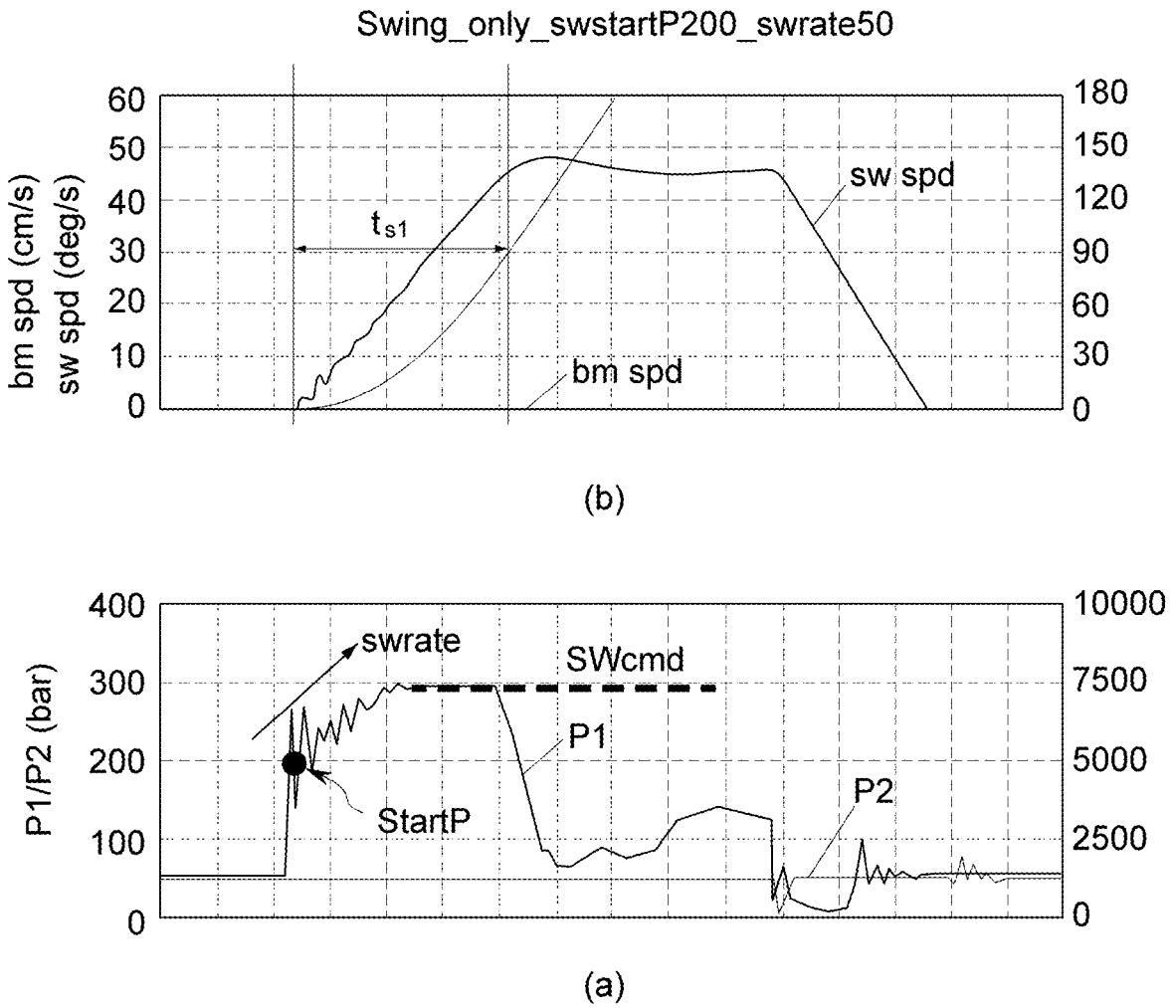
Figure 13:
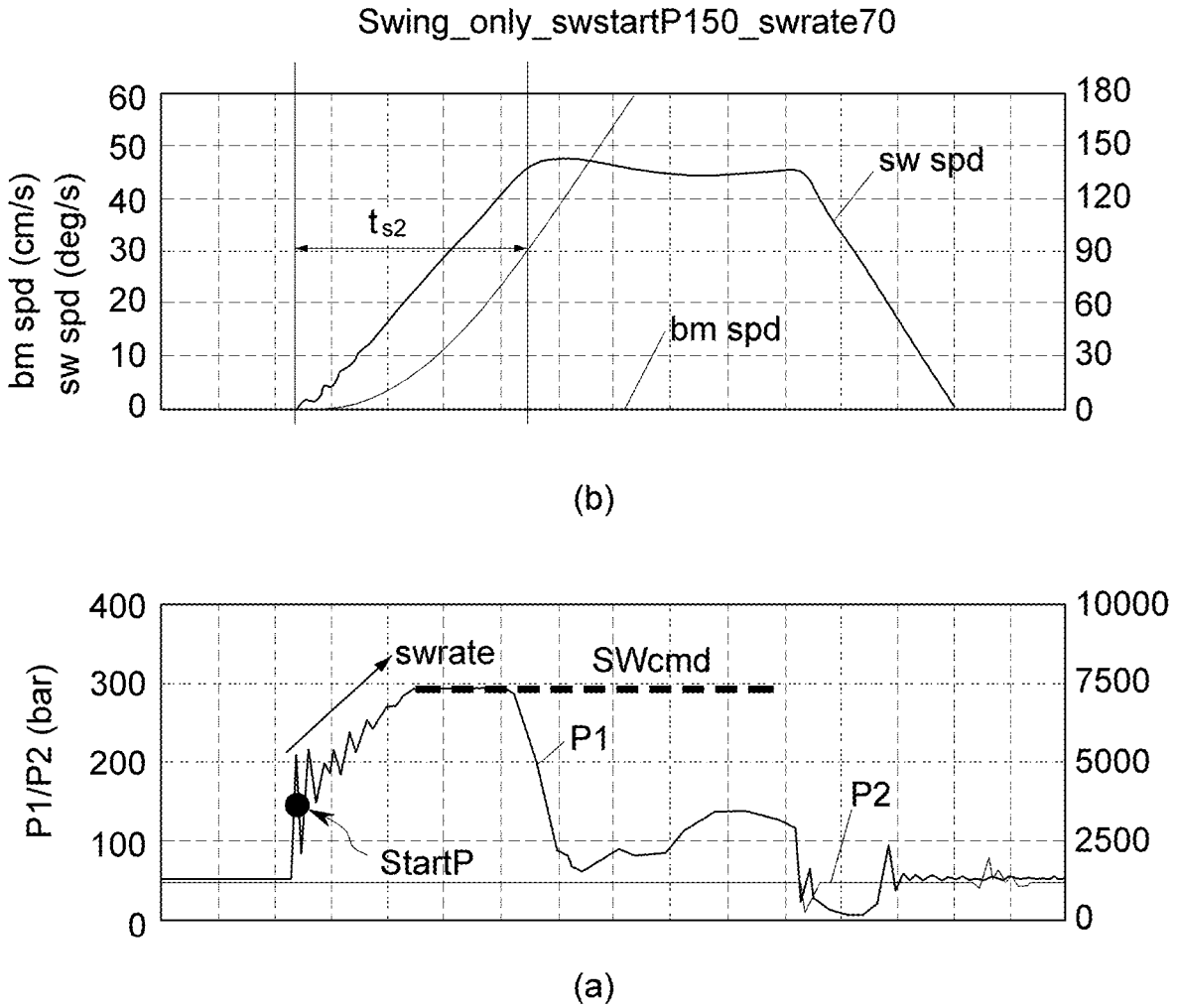

FIGS. 11 to 13 illustrate a case where only the rotation of the swing body 140 is performed without manipulating the boom 110.

As shown in FIG. 11, FIG. 11(*a*) shows the pressure change of the first pump 310 over time when the pressure command value SWcmd is set to 300, the initial pressure StartP of the pump is set to 200, and the pressure increase gradient swrate of the pump is set to 500.

As shown in FIG. 12, FIG. 12(*a*) shows the pressure change of the first pump 310 over time when the pressure command value SWcmd is set to 300, the initial pressure StartP of the pump is set to 200, and the pressure increase gradient swrate of the pump is set to 50.

As shown in FIG. 13, FIG. 13(*a*) shows the pressure change of the first pump 310 over time when the pressure command value SWcmd is set to 300, the initial pressure StartP of the pump is set to 150, and the pressure increase gradient swrate of the pump is set to 70.

Therefore, it can be seen that the pressure increase gradient of the first pump 310 of FIG. 12(*a*) or FIG. 13(*a*) is relatively gentler than that of FIG. 11(*a*). That is, if the pressure increase gradient of the first pump 310 is gentle, it can be seen that time required for the swing body 140 of the first pump 310 of FIG. 11(*a*) to rotate from 0 to 90 degrees is longer than that required for the swing body 140 of the first pump 310 of FIG. 11(*b*) and FIG. 12(*b*).

Specifically, as shown in FIGS. 11(*b*) to 13(*b*), time required for the swing body 140 to rotate from 0 to 90 degrees is $t_{sd}<t_{s1}<t_{s2}$.

The control part 500 may adjust the pressure command value SWcmd so that the discharge pressure of the first pump 310 maintains a set pressure, thereby controlling the pressure increase gradient of the first pump 310. Accordingly, the construction machine 101 can maintain swing acceleration.

Hereinafter, the operation of the construction machine 101 according to an embodiment of the present disclosure will be described with reference to FIGS. 1 to 15.

The worker determines whether the boom priority operation or the swing priority operation is required, as needed.

When the manipulation part 400 is manipulated to select the boom priority, the control part 500 causes the second pump 320 to operate with a set maximum horsepower. That is, the control part 500 causes the second pump 320 to operate at maximum horsepower.

The control part 500 controls the performance of the first pump 310. Specifically, the control part 500 controls the performance of the first pump 310 in the mode 510 selected by the worker. As shown in FIGS. 2 and 3, the multiple modes 510 are set and stored in the control part 500, and these settings may be changed by the worker.

That is, the control part 500 may control the initial pressure StartP of the first pump 310 and the horsepower increase gradient 721 of the pump in the selected mode 510.

Specifically, the control part 500 may control the pressure command value SWcmd to control the horsepower increase gradient 721 of the first pump 310.

At this time, the worker manipulates the joystick to operate the boom. In response to this signal, the second pump 320 operates at the maximum horsepower to deliver the hydraulic oil to the boom cylinder 210. Also, the worker manipulates the joystick to swing the swing body 140, and the first pump 310 is operated in a state where the swing horsepower increase gradient is limited, so that the swing speed of the swing body 140 may be formed slowly.

The control part 500 adjusts the horsepower ratio of the first pump 310 and the second pump 320 according to the selection of the manipulation part 400 and the mode 510 selected and stored by the worker.

The control part 500 controls a main control valve 600 to supply the hydraulic oil of the main pump part 300. Specifically, the control part 500 may receive information from the joystick and control the first boom valve 610 to supply the hydraulic oil to the boom cylinder 210, or control the second boom valve or the swing valve 620 to supply the hydraulic oil to the boom cylinder 210 or the swing motor 230.

Therefore, the control part 500 may perform the swing priority or boom priority operation depending on the information selected by the manipulation part 400.

Figure 14:
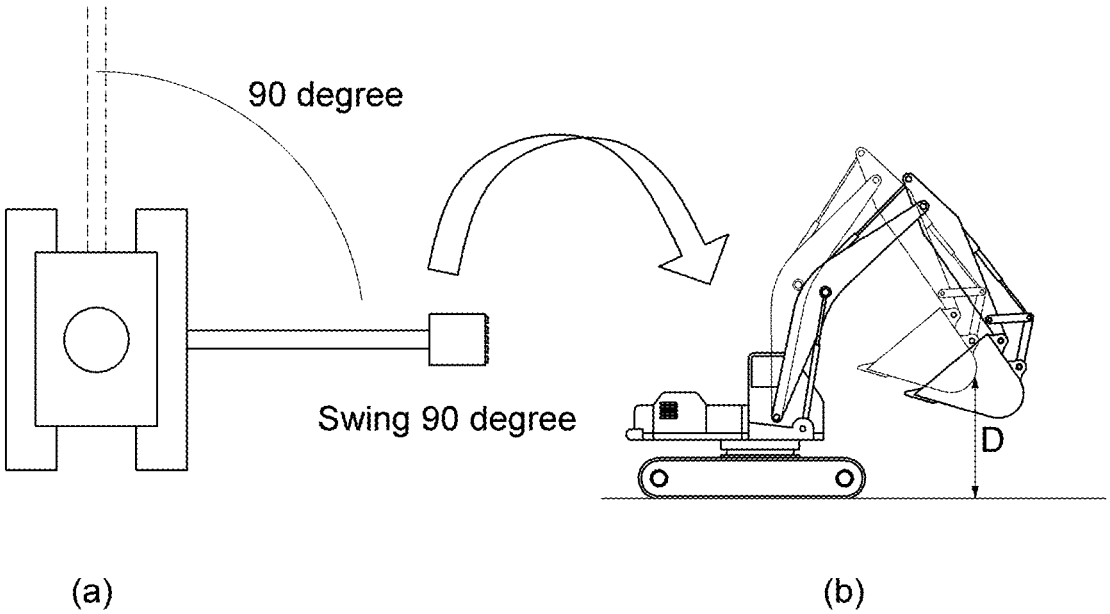
FIG. 14 shows a state in which the swing body is rotated 90 degrees according to an embodiment of the present disclosure.
Figure 15:
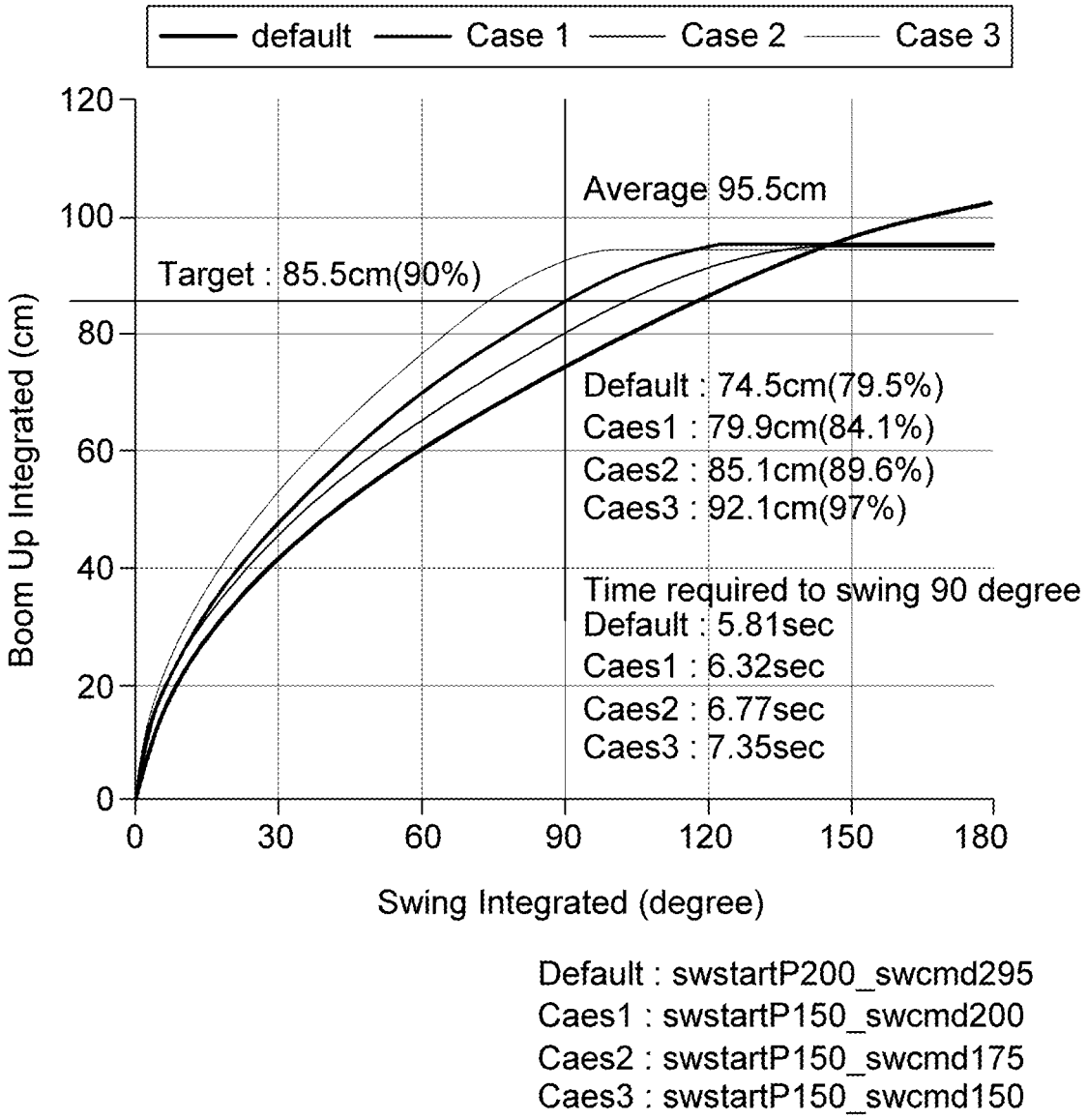
FIG. 15 shows time required for the swing body to rotate from 0 to 90 degrees and a change in the extension length of a boom cylinder according to a change in pressure command value, according to an embodiment of the present disclosure.

In this case, as shown in FIGS. 14 and 15, when the swing body 140 is operated at a rotation angle from 0 to 90 degrees and the boom 110 is also operated together, the degree of freedom in adjusting the height of the boom may be formed significantly compared to a conventional case Default. Specifically, it can be seen that the tensile length of the boom cylinder 210 when the swing body 140 is at 90 degrees is improved compared to the conventional one.

Specifically, as shown in FIG. 15, when the swing body 140 is rotated up to 90 degrees according to a change in the pressure command value SWcmd of the control part 500 while the starting point StartP of the first pump 310 is fixed, it is shown that the height of the boom 110, that is, the extension length of the boom cylinder 210 is variable.

That is, the horsepower increase gradient 721 of the first pump 310 may be varied according to a change in the pressure command value SWcmd of the control part 500, and thus the degree of freedom in the extension length of the boom cylinder 210 may be varied.

By this configuration, the construction machine 101 according to an embodiment of the present disclosure can increase the efficiency of loading through the height adjustment of the boom 110 when the swing body 140 rotates 90 degrees. Specifically, when the swing body 140 rotates 90 degrees, the height adjustment between the boom and the ground is increased compared to the prior art, so that the efficiency of loading using the boom can be increased.

Although the preferred embodiments of the present disclosure have been described above with reference to the accompanying drawings, it will understood by those skilled in the art that various modifications and changes may be made to the present disclosure without departing from the idea and scope of the present disclosure as set forth in the following claims.

Therefore, the embodiments described above should be understood as illustrative and not restrictive in all respects, and the scope of the present disclosure is defined by the claims described below, and all changes or modifications derived from the meaning and scope of the claims and their equivalent concepts should be interpreted as being included in the scope of the present disclosure.

INDUSTRIAL APPLICABILITY

A construction machine according to an embodiment of the present disclosure can increase the degree of freedom in extending a boom cylinder, which is mechanically difficult to expand, through the horsepower distribution of a pump.

[DESCRIPTION OF REFERENCE NUMERALS]

| | |
|---|---|
| 100: construction machine | 110: boom |
| 120: arm | 140: swing body |
| 210: boom cylinder | 220: arm cylinder |
| 230: swing motor | |
| 300: main pump part | 310: first pump |
| 320: second pump | 400: manipulation part |
| 500: control part | 510: mode |
| 700: information input/output part | 710: response of pump |

-continued

[DESCRIPTION OF REFERENCE NUMERALS]

| | |
|---|---|
| 711: initial horsepower of pump | 720: control speed of pump |
| 721: horsepower increase gradient of pump | 900: pump pressure sensor |
| SWcmd: pressure command value | |

What is claimed is:

1. A construction machine including a swing motor, a boom cylinder, and an arm cylinder, the construction machine comprising:

a main pump part including a first pump, which supplies hydraulic oil to the swing motor, and a second pump, which supplies the hydraulic oil to the boom cylinder and/or the arm cylinder;

a manipulation part through which a boom priority operation or a swing priority operation is selected so that either the first pump or the second pump is operated at the maximum value of a stored horsepower ratio;

a control part for controlling the performance of the other pump not selected by the manipulation part from among the first pump and the second pump, wherein the performance of the other pump controlled by the control part comprises a response of the other pump or a control speed of the other pump, a mode capable of changing the response of the other pump or the control speed of the other pump is stored in the control part; and an information input/output part displaying a selection status of the mode and receiving information for changing a setting of the mode.

2. The construction machine of claim 1, wherein the response of the other pump comprises a change in initial horsepower of the other pump.

3. The construction machine of claim 1, wherein the control speed of the other pump comprises a change in horsepower increase gradient of the other pump.

4. The construction machine of claim 1, wherein the control part changes a pressure command value for maximum pressure control of the first pump when the second pump is selected by the manipulation part, thereby changing the control speed of the first pump.

5. The construction machine of claim 1, wherein the information input/output part is configured to change setting of a horsepower ratio pre-stored in the manipulation part.

6. A construction machine including a swing motor that rotates a swing body, a boom cylinder that changes a height of a boom supported on the swing body, and an arm cylinder that changes an angle between an arm supported on the boom and the boom, the construction machine comprising:

a main pump part including a first pump, which supplies hydraulic oil to the swing motor, and a second pump, which supplies the hydraulic oil to the boom cylinder;

a manipulation part controlling the first pump and the second pump at a pre-stored horsepower ratio, thereby selecting either a boom priority operation or a swing priority operation;

a control part controlling performance of the first pump so that the second pump is controlled at a pre-stored maximum horsepower ratio and a swing speed increase rate of the swing body is reduced when the boom priority operation is selected by the manipulation part, wherein the control part stores multiple modes in which a response of the first pump and the second pump and a control speed of the first pump and the second pump are settable to be different; and an information input/output part displaying a selection status of a mode of the multiple modes and receiving information for changing a setting of the mode.

7. The construction machine of claim 6, wherein the control part is configured to control the performance of the first pump by adjusting a pressure command value.

* * * * *